US005782936A

United States Patent [19]

Riley

[11] Patent Number: 5,782,936

[45] Date of Patent: Jul. 21, 1998

[54] ADDITIVE COMPOSITIONS FOR LPG FUEL

[75] Inventor: Richard A. Riley, Bridgeport, Ohio

[73] Assignee: Suburban Propane, L.P., Whippany, N.J.

[21] Appl. No.: 842,390

[22] Filed: Apr. 23, 1997

[51] Int. Cl.[6] ..... C10L 3/12

[52] U.S. Cl. ..... 44/300; 44/443; 44/450; 44/451; 585/14

[58] Field of Search ..... 44/300, 450, 451, 44/443; 585/14; 510/413; C10L 1/02, 1/04, 3/12

[56] References Cited

U.S. PATENT DOCUMENTS

| | | | |
|---|---|---|---|
| 1,516,907 | 11/1924 | Backhaus | 44/451 |
| 2,322,617 | 6/1943 | Dayhuff . | |
| 2,327,835 | 8/1943 | White | 585/14 |
| 2,786,745 | 3/1957 | Stayner | 44/443 |
| 2,914,479 | 11/1959 | Tom | 44/443 |
| 3,167,514 | 1/1965 | Baker | 510/413 |
| 3,781,171 | 12/1973 | Maccaferri . | |
| 4,682,984 | 7/1987 | Epler | 44/443 |
| 4,844,713 | 7/1989 | Yu | 44/300 |
| 5,031,648 | 7/1991 | Lutener | 510/413 |
| 5,055,625 | 10/1991 | Neidiffen et al. . | |
| 5,116,390 | 5/1992 | Rodrigues . | |
| 5,417,725 | 5/1995 | Graves | 44/451 |
| 5,575,822 | 11/1996 | Wilkins, Jr. | 585/14 |

FOREIGN PATENT DOCUMENTS

| | | |
|---|---|---|
| 3525246 | 2/1986 | Germany . |
| 360055085 | 3/1985 | Japan . |
| 2066288 | 7/1981 | United Kingdom . |

*Primary Examiner*—Jacqueline V. Howard
*Assistant Examiner*—Cephia D. Toomer
*Attorney, Agent, or Firm*—Klauber & Jackson

[57] ABSTRACT

Additives for LPG fuels which reduce fouling, thereby increasing fuel efficiency while reducing particulates and carbon monoxide emissions, are provided. The additive compositions are produced from commonly available low cost products and comprise about 97.3 to 99.4 volume percent of a petroleum hydrocarbon which is a mixture of middle petroleum distillates and petroleum naphtha, about 0.3 to 1.5 volume percent of methanol and 0.3 to 1.2 volume percent ethoxylated alkylphenol. Optional components, such as upper cylinder lubricants, odorants and antiwear agents, may also be included in the additive composition.

24 Claims, No Drawings

ADDITIVE COMPOSITIONS FOR LPG FUEL

BACKGROUND OF THE INVENTION

Compositions of various types have been employed as additives for hydrocarbon fuels and lubricants, to produce improvements in their combustion or other properties. For example, U.S. Pat. No. 3,781,171 discloses an additive composition for the "combustion air" in internal combustion engines, comprising an inert support, diphenyl hexamethylenetetramine and a binding agent chosen from camphor or paradichlorobenzene. U.S. Pat. No. 5,116,390 discloses a combustion catalyst for organic liquid fuels, comprising naphthalene, toluene and benzyl alcohol. U.S. Pat. No. 5,055,625 discloses a gasoline additive comprising toluene and a $C_8$ alkyl aromatic component selected from ethylbenzene, paraxylene, metaxylene and orthoxylene. U.S. Pat. No. 2,327,835 discloses a propane fuel comprising propane and normally liquid hydrocarbon fuels such as gasolines which is designed to have the vapor pressure and properties of butane. U.S. Pat. No. 2,322,617 discloses methods for odorizing liquefied gases.

Liquified petroleum gases (LPG), which are primarily comprised of propane and butane, are widely used as engine fuels. These products are obtained from natural gas and crude oil processing operations and are generally classified as commercial propane, commercial butane and commercial butane-propane mixtures in accordance with specifications published by the Gas Processor's Association.

Heavier hydrocarbons and sulfur-containing products, by-products of the refining process, are also present in commercial LPG fuels. The amounts of these undesirable substituents will vary depending on the feedstock and recovery method used. These impurities in LPG fuel result in the formation of undesirable deposits in lockoffs, converters and carburetors. The problem is particularly pronounced in the converter where the LPG is vaporized, i.e., the pressure is reduced and the LPG is allowed to expand. As the fuel passes from the liquid to the gaseous state with the accompanying cooling associated therewith, the heavy hydrocarbon impurities "drop out" or condense as viscous waxy deposits coating the converter components and severely impairing its efficiency. The deposits can build up to such an extent that the converter must be removed and cleaned at regular intervals and, in some instances, replaced.

The LPG Converter or Vaporizer-Regulator is in effect a natural cracking plant, and the more heat is caused by retarded timing, dirty cooling systems, poorly conditioned engines or the like, the more impurities will collect therein. Various solvents can be used to clean the disassembled converter components to remove such deposits.

Buildup of these heavy deposits in the converter and carburetor, a condition referred to as fouling, also reduces fuel efficiency and power and increases particulates emissions and carbon monoxide (CO) emissions. Increased CO emission is of particular concern to the health and safety of workers in enclosed environments, such as in warehouses where LPG fueled forklifts and small trucks are commonly operated. In such environments, CO emissions cannot exceed the 50 ppm limit established by OSHA.

In an effort to reduce undesirable particulate and CO emissions and to alleviate the other problems associated with the use of LPG fuels, an additive for LPG fuels, CGX-4, is commercially available. The "CGX" is reported to stand for "Carburation Gas Additive" and the numeral 4 represents the additive's four major components which are disclosed in product literature to consist of (1) an emulsifying agent, (2) a polar organic solvent, (3) a group or blend of compounds that function as a combustion improver and (4) an upper cylinder lubricant. The upper cylinder lubricant is disclosed to be a top oil having a flash point of 425° F. The four components are dispersed in a petroleum-base solvent and it is specified that the CGX-4 contains no alcohol.

It would be highly useful if an additive for LPG fuel were available based on commonly available, low cost compounds. It would be even more advantageous if the composition, when added to LPG at low levels, reduced fouling of lockoffs, converters and carburetors, increased fuel efficiency and reduced particulates and CO emission. These and other advantages are realized by the additive compositions of the present invention which will be described in greater detail below.

SUMMARY OF THE INVENTION

The compositions of the invention, which are useful as additives for LPG fuel to reduce CO and particulate emissions, improve fuel efficiency and reduce fouling, comprise the following components (the indicated volume percentages are based on the volume of the composition:

(A) about 97.3 to 99.4, preferably 97.8 to 98.5, volume percent of a petroleum hydrocarbon fraction having an initial boiling point of at least about 170° C. and a final boiling point of not greater than about 300° C. and comprising a mixture of middle petroleum distillates and petroleum naphtha at a volume ratio of 2:1 to 10:1, preferably 3:1 to 7:1 and most preferably 4:1 to 5.5:1;

(B) about 0.3 to 1.5, preferably 0.5 to 1.25, volume percent methanol; and (C) about 0.3 to 1.2, preferably 0.5 to 1.0, volume percent of an ethoxylated alkylphenol.

There are also provided LPG fuels containing from 100 to 5,000, preferably 300 to 2,500, volume parts of said additive composition per million volume parts of the LPG fuel.

DETAILED DESCRIPTION OF THE INVENTION

The improved LPG additives of the invention which reduce fouling and undesirable emissions and improve fuel efficiency comprise small but effective amounts of methanol and an ethoxylated alkylphenol in a petroleum hydrocarbon fraction. The petroleum hydrocarbon fraction is the major component of the additive composition and comprises a mixture of middle petroleum distillates and petroleum naphtha having the initial and final boiling points and present in the volume ratio indicated above. Low levels (i.e. 100 to 5,000 volume parts per million volume parts of LPG) of the additive are added to the LPG for the purposes of this invention.

The petroleum hydrocarbons used to formulate the additive compositions are comprised of distillation fractions obtained from conventional petroleum refining processes. Such processes typically include hydroprocessing, steam cracking, catalytic cracking, alkylation, dewaxing, desulfurization, hydrorefining, reforming, etc. operations. In general, the petroleum hydrocarbon fraction used should have a boiling range such that significant vaporization does not occur in the converter but not so high as to include substantial amounts of excessively heavy distillates which cannot be carried through the converter and carburetor with the fuel.

Fractions characterized as heavy naphthas and middle distillates encompass the useful petroleum hydrocarbons for the present additives. Common paraffinic, aromatic and naphthenic products included within these fractions include kerosene, No. 2 fuel oil, Stoddard solvent, petroleum spirits, mineral spirits, mineral seal oil and the like. The wax content of the petroleum hydrocarbons is preferably as low as is commercially practicable.

The petroleum hydrocarbon fraction employed for the present additives has an initial boiling point of at least about 170° C. and a final boiling point of not higher than about 300° C. as determined by ASTM Test Method D 86-90, using apparatus as specified in ASTM Method E 133-86. To achieve this boiling point range, a middle petroleum distillate is combined with a petroleum naphtha at a volume ratio from about 2:1 to about 10:1.

In a highly useful embodiment of the invention, the middle petroleum distillate used is kerosene and the petroleum naphtha is mineral spirits and the components are utilized at a volume ratio from 3:1 to 7:1 and, more preferably, from 4:1 to 5.5:1. Other petroleum fractions, such as light gas oils, may be included with the middle distillate and petroleum naphtha as long as the boiling point range remains essentially within the above-specified limits.

Ethoxylated alkylphenols are commercially available nonionic surfactants. They are produced by condensing an alkylphenol with ethylene oxide in accordance with conventional procedures. The degree of ethoxylation typically ranges from 3 to 30 or more ethylene oxide units. The ethoxylated alkylphenols useful for the additive compositions of the invention will generally have 6 to 20 moles of ethylene oxide condensed with the alkylphenol. Generally, the alkylphenol will contain a single alkyl group of 6 to 18, preferably 8 to 16, carbon atoms. The preferable ethoxylated alkylphenols for use in the present invention ethoxylated nonylphenol and ethoxylated octylphenol.

Whereas compositions containing the above-defined petroleum hydrocarbon fraction and methanol are effective additives for LPG fuels to reduce fouling and emissions while improving fuel efficiency, one or more other ingredients may be present in the formulation. Optional ingredients may be present in the formulation. Optional ingredients which can be advantageously added include odorants, heavier petroleum fractions which can function as upper cylinder lubricants, antiwear additives and any of the broad spectrum additives suitable for multifunctional use. If additives are included in the formulation, the so-called "ashless additives" are preferably used wherever possible to reduce engine wear.

Any of the lower molecular weight thiols commonly used as odorants for natural gas and LPG can be included in the formulation. In fact, if the additive is to be added during bulk LPG storage this is a convenient means of incorporating the odorant. Blends of these thiols may also be employed. Thiols which are employed as odorants which can be used with the additives of the invention include ethanethiol, 2-methyl-2-propanethiol, 1-propanethiol, 2-propanethiol, dimethyl sulfide and mixtures thereof. Ethanethiol is particularly useful for LPG.

Conventional additives used in distillate fuels and lubricating oils can also be advantageously included in the formulation at low levels. These can include antiwear additives and products which are multifunctional in nature, e.g., retard oxidation, improve wear, retard rust, improve water tolerance, deactivate metals and the like. Antiwear agents used are generally any of the zinc- and phosphorus-containing organic compounds known to the art. These are primarily zinc diorganodithiophosphates and, more preferably, zinc dialkyldithiophosphates.

Another optional ingredient which can be used for formulating the additives of the invention is a petroleum product capable of lubricating the top cylinder areas. These upper cylinder lubricants, sometimes referred to as "top oils," are typically heavier petroleum fractions. Most LPGs already contain such heavier petroleum fractions, the amount depending on the source of the LPG, i.e., feedstock used, and the refining process. In fact, these heavier petroleum fractions are the very materials which drop out of the LPG and foul the lockoffs, converters and carburetors. However, in view of the ability of the additives of the invention to effectively disperse the heavier hydrocarbons and prevent fouling problems associated therewith, it is surprisingly possible to add limited quantities of additional heavy petroleum fractions to enhance top cylinder lubrication. This can be effectively accomplished by adding small amounts of any heavier petroleum fractions, such as a base stock used for formulating 5W-30, 10W-30, 15W-40 engine oils, or the like. Such base stocks should preferably be free of any performance additives typically used in engine oils; especially, ash-producing additives.

The amounts of components such as those mentioned above which can optionally be included in the formulation can vary widely. For example, odorants can be employed at extremely low levels whereas larger amounts of top oil and antiwear additives can be advantageous. However, any optional component should not exceed 1 volume percent of the total additive formulation. The total amount of all optional additives should not generally exceed 1.75 volume percent and, more preferably, will range from 0.01 volume percent up to 1.25 volume percent.

The fully formulated additive may be added to bulk storage LPG or it may be introduced directly into fuel tanks of LPG fueled vehicles. In the latter case, this may be conveniently accomplished by the use of injectors or the like. Most commonly, the additive is incorporated during bulk storage and is dispersed throughout the total volume of the LPG. The amount of additive used in the LPG can range from 100 to 5000 ppm; however, additive levels of 300 to 2500 ppm are most advantageously used with commercial LPG fuels.

The invention is described in greater detail by reference to the following examples and comparative examples in which all proportions and percentages are on a volume basis unless otherwise indicated. The examples are provided for illustration purposes only and are not intended to limit the invention. Numerous variations within the scope of the invention will be apparent to those skilled in the art.

Since various solvents had been found effective in cleaning fouled converter parts, initial trials involved the use of solvents including lacquer thinner, commercial fuel injector cleaner and commercial carburetor cleaner as fuel additives. While these materials all prevented fouling of the converter, the solvents had adverse effects on the fuel system components, especially the converter diaphragm.

EXAMPLE 1

A test of the fuel additive composition of the invention was conducted on over the road (OTR) vehicles. The OTR vehicles tested were propane powered delivery trucks. The additive composition was designed to prevent undesirable oil buildup in automotive propane equipment by keeping heavier petroleum ends emulsified in propane enabling them to pass through to the engine for combustion. The purpose of the test was to determine if the fuel additive would perform its intended function under actual driving conditions.

The additive composition employed in this test consisted of the following formulation:

| | | |
|---|---|---|
| 1. | Kerosene | 79.68% |
| 2. | Mineral Spirits | 18.75% |
| 3. | Methanol | 1.09% |
| 4. | Ethoxylated Nonylphenol | 0.46% |
| | Sub Total | 99.98% |
| 5. | Ethyl Mercaptan (not used in test) | 0.02% |
| | Total | 100.00% |

Test Procedure: No special instructions were given to the test vehicle operators, they were to use their trucks as usual. The additive was measured into 1000 gallon dispensers used to fuel the delivery trucks.

The additive concentration used for the test was 0.98 ml of additive composition per liter of propane fuel. Before and after photographs were taken of the interiors of the Model E regulators of the delivery trucks. The depth of accumulated oil in each of the over the road vehicle's regulators was also measured. These measurements were compared to identical measurements taken at the end of the test. The results are shown on the tables set forth below. Observation of the vehicle regulator was chosen because of the propensity of this device to become contaminated with residual oil.

These are the observations taken of the vehicles tested before and after use of the additive. The Model E regulator of the Over the Road vehicles is positioned horizontally so the accumulated deposits are easily measured. Photographs were not revealing of the depth of these deposits, and so measurements were also used.

TABLE I

| Start Day | Veh. No. | Start Km. | Start Oil Depth |
|---|---|---|---|
| 1 | 3988 | 201570 | 6.35 mm |
| 1 | 6887 | 48897 | 7.62 mm |
| 1 | 6883 | 59168 | 9.90 mm |
| 1 | 6885 | 50871 | 10.16 mm |

| End Day | Veh. No. | End Km. | End Oil Depth | Measured Difference |
|---|---|---|---|---|
| 152 | 3988 | 206463 | 5.08 mm | −1.27 mm |
| 152 | 6887 | 51647 | 6.98 mm | −0.64 mm |
| 152 | 6883 | 59168 | 7.62 mm | −2.28 mm |
| 152 | 6885 | 50871 | 8.89 mm | −1.27 mm |

The vehicles which used the additive and were driven regularly showed no indication of additional oil accumulation. The additive performed so well in keeping the heavy petroleum ends emulsified that a cleansing action was observed in the regulators. As the additive enhanced propane passed through the regulators, it slowly absorbed accumulated oil. All the tested vehicles showed signs of reduced oil deposits in their regulators. Considering the brief time period that the additive was in use, these reductions are significant. With extended or continuous use of the additive, additional and permanent elimination of deposited oil could be achieved.

The test vehicles traveled a total of 27,362 km, averaging 6,640.49 km each. The average depth of oil removed was 1.365 mm. This equates on average to 1 mm of oil build up removed per each 54,920 km traveled. Once clean, these components will remain so through continued use of the fuel additive.

EXAMPLE 2

Example 1 was repeated with a series of vehicles at a different geographic location. All other test conditions, including the additive composition, were identical to those of Example 1.

TABLE II

| Start Day | Veh. No. | Start Km. | Start Oil Depth |
|---|---|---|---|
| 1 | 1986 | 62922 | 6.35 mm |
| 1 | 5809 | 183361 | 7.62 mm |
| 1 | 95152 | 40269 | 3.17 mm |

| End Day | Veh. No. | End Km. | End Oil Depth | Measured Difference |
|---|---|---|---|---|
| 158 | 1986 | 75723 | 2.54 mm | −3.81 mm |
| 152 | 5809 | 192360 | 4.45 mm | −3.17 mm |
| 152 | 95152 | 48255 | 2.54 mm | −0.63 mm |

The vehicles which used the additive and were driven regularly showed no indication of additional oil accumulation. The additive performed well in reducing the oil level observed in the regulators. As the additive enhanced propane passed through the regulators it slowly absorbed accumulated oil. All the tested vehicles showed signs of reduced oil deposits in their regulators. Considering the brief time period that the additive was in use, these reductions are significant. With extended or continuous use of the additive, additional and permanent elimination of deposited oil could be achieved.

The test vehicles traveled a total of 29785 km, averaging 9,928.33 km each. The average depth of oil removed was 2.54 mm. This equates on average to 1 mm of oil build up removed per each 3,906 km traveled. At this rate, the vehicles' regulators could be cleaned free of accumulated oil with an additional 9,921 to 17,380 km driven, depending on the amount of the oil deposited. Also, once clean, these components will remain so through continued use of the fuel additive.

EXAMPLE 3

This test was conducted at the same geographic location and under the same conditions as that of Example 2, but was conducted on forklift vehicles. The purpose of this test was to determine if the additive composition of the invention would perform its intended function under actual forklift conditions at various weight handling capacities.

The test was conducted over a four month period of time. No measurement of the accumulated oil depth was taken in this forklift test inasmuch as the Model J regulator is positioned vertically. In this position, the accumulated oil depth cannot be measured. Instead, photographs were taken to demonstrate the cleansing effect of the additive as it passes through propane components and carries accumulation along to be burned in the engine.

The initial photographs of the regulators operating on untreated fuel showed that the internal components of these regulators were oil soaked and dirty. The final photographs of the regulators operating on treated fuel showed that the Model J regulators are cleaner than in the initial photographs. It is clear that the additive performed in its intended capacity by removing accumulated dirt and oil, and preventing further deposits. Continued use of the additive can eliminate poor engine performance in forklifts caused by oil clogged vaporization components, which is a common complaint of forklift maintenance mechanics.

EXAMPLE 4

This test was carried out in a manner identical to that of Example 3, but at a different geographic location over a period of approximately four months. No special instructions were given to the test vehicle operators, they were to use their forklifts as usual. The additive was measured into 1000 gallon dispensers at each district and used to refill 33.5 lb forklift cylinders for delivery to the motorfuel customers participating in the test.

The forklift test results were evidenced by before and after photographs. The after photographs indicated that the Model J regulators were remarkably clean and nearly dry. It is clear that the additive performed in its intended capacity by removing accumulated dirt and oil, and preventing further deposits. Continued use of the additive can eliminate poor engine performance in forklifts caused by oil clogged vaporization components, which is a common complaint of forklift maintenance mechanics, causing poor engine performance and increased harmful exhaust emissions of carbon monoxide. In particular, the result achieved in this test were surprisingly good. The internal regulator parts were very clean, and in a like-new condition.

What is claimed is:

1. An additive composition for LPG fuel comprising:

(A) about 97.3 to 99.4 volume percent of a petroleum hydrocarbon composition having an initial boiling point of at least about 170° C. and a final boiling point of not greater than about 300° C., said petroleum hydrocarbon composition comprising a mixture of middle petroleum distillates and petroleum naphtha at a volume ratio of 2:1 to 10:1;

(B) about 0.3 to 1.5 volume percent of methanol; and (C) about 0.3 to 1.2 volume percent of an ethoxylated alkylphenol.

2. The additive composition of claim 1 wherein the petroleum hydrocarbon composition is present in the additive composition in an amount of 97.8 to 98.5 volume percent.

3. The additive composition of claim 1 wherein the volume ratio of middle petroleum distillates to petroleum naphtha is in the range of 3:1 to 7:1.

4. The additive composition of claim 3 wherein the volume ratio of middle petroleum distillates to petroleum naphtha is in the range of 4:1 to 5.5:1.

5. The additive composition of claim 1 wherein the methanol is present in the additive composition in an amount of 0.5 to 1.25 volume percent.

6. The additive composition of claim 1 wherein the ethoxylated alkylphenol is present in the additive composition in an amount of 0.5 to 1.0 volume percent.

7. The additive composition of claim 1 wherein the ethoxylated alkylphenol is prepared by the condensation of 6 to 20 moles of ethylene oxide with the alkylphenol.

8. The additive composition of claim 7 wherein the ethoxylated alkylphenol comprises ethoxylated nonylphenol.

9. The additive composition of claim 7 wherein the ethoxylated alkylphenol comprises ethoxylated octylphenol.

10. The additive composition of claim 1 further comprising a thiol odorant.

11. The additive composition of claim 1 further comprising a zinc dialkyldithiophosphate anti-wear agent.

12. The additive composition of claim 1 further comprising an upper cylinder lubricant.

13. An LPG fuel composition containing 100 to 5000 ppm of an additive composition comprising:

(A) about 97.3 to 99.4 volume percent of a petroleum hydrocarbon composition having an initial boiling point of at least about 170° C. and a final boiling point of not greater than about 300° C., said petroleum hydrocarbon composition comprising a mixture of middle petroleum distillates and petroleum naphtha at a volume ratio of 2:1 to 10:1;

(B) about 0.3 to 1.5 volume percent of methanol; and (C) about 0.3 to 1.2 volume percent of an ethoxylated alkylphenol.

14. The LPG fuel composition of claim 13 wherein the petroleum hydrocarbon composition is present in the additive composition in an amount of 97.8 to 98.5 volume percent.

15. The LPG fuel composition of claim 14 wherein the volume ratio of middle petroleum distillates to petroleum naphtha is in the range of 3:1 to 7:1.

16. The LPG fuel composition of claim 15 wherein the volume ratio of middle petroleum distillates to petroleum naphtha is in the range of 4:1 to 5.5:1.

17. The LPG fuel composition of claim 13 wherein the methanol is present in the additive composition in an amount of 0.5 to 1.25 volume percent.

18. The LPG fuel composition of claim 13 wherein the ethoxylated alkylphenol is present in the additive composition in an amount of 0.5 to 1.0 volume percent.

19. The LPG fuel composition of claim 13 wherein the ethoxylated alkylphenol is prepared by the condensation of 6 to 20 moles of ethylene oxide with the alkylphenol.

20. The LPG fuel composition of claim 19 wherein the ethoxylated alkylphenol comprises ethoxylated nonylphenol.

21. The LPG fuel composition of claim 19 wherein the ethoxylated alkylphenol comprises ethoxylated octylphenol.

22. The LPG fuel composition of claim 13 further comprising a thiol odorant.

23. The LPG fuel composition of claim 13 further comprising a zinc dialkyldithiophosphate anti-wear agent.

24. The LPG fuel composition of claim 13 further comprising an upper cylinder lubricant.

* * * * *